US007753347B2

(12) United States Patent
Aihara et al.

(10) Patent No.: US 7,753,347 B2
(45) Date of Patent: Jul. 13, 2010

(54) LAYERED SCAVENGING CARBURETOR

(75) Inventors: Tamio Aihara, Miyagi-Pref. (JP); Bunichi Ohtsuki, Miyagi-Pref. (JP); Kazuyuki Uenoyama, Kanagawa Pref. (JP)

(73) Assignees: Walbro Engine Management, L.L.C., Tucson, AZ (US); Mitsubishi Heavy Industries, Ltd., Tokyo (JP)

( * ) Notice: Subject to any disclaimer, the term of this patent is extended or adjusted under 35 U.S.C. 154(b) by 370 days.

(21) Appl. No.: 11/835,849

(22) Filed: Aug. 8, 2007

(65) Prior Publication Data

US 2008/0041466 A1 Feb. 21, 2008

(30) Foreign Application Priority Data

Aug. 17, 2006 (JP) ..... 2006-222219
Apr. 26, 2007 (JP) ..... 2007-116978

(51) Int. Cl.
*F02M 9/08* (2006.01)

(52) U.S. Cl. ..... 261/23.3; 251/309; 261/44.8; 261/46; 261/DIG. 1

(58) Field of Classification Search ..... 261/23.2, 261/23.3, 44.6, 44.8, 45, 46, 54, 55, 63, DIG. 1; 251/208, 209, 309
See application file for complete search history.

(56) References Cited

U.S. PATENT DOCUMENTS

| | | | | |
|---|---|---|---|---|
| 2,407,534 | A * | 9/1946 | Carlson | 261/41.5 |
| 4,058,093 | A * | 11/1977 | Kohno et al. | 261/23.2 |
| 4,294,205 | A * | 10/1981 | Iiyama et al. | 123/274 |
| 4,530,805 | A * | 7/1985 | Abbey | 261/53 |
| 6,135,428 | A * | 10/2000 | Schliemann et al. | 261/35 |
| 6,186,482 | B1 * | 2/2001 | Nomura | 261/43 |
| 6,298,996 | B1 | 10/2001 | Spiegel et al. | |
| 6,328,288 | B1 | 12/2001 | Gerhardy | |
| 6,481,699 | B1 * | 11/2002 | Aihara et al. | 261/34.2 |
| 6,561,160 | B2 * | 5/2003 | Suzuki et al. | 123/337 |
| 6,688,585 | B2 | 2/2004 | Braun et al. | |
| 6,827,338 | B2 * | 12/2004 | Nonaka | 261/44.3 |
| 6,843,469 | B1 * | 1/2005 | Nonaka | 261/44.3 |
| 7,104,253 | B1 | 9/2006 | Dow et al. | |
| 2005/0001335 | A1 * | 1/2005 | Nonaka | 261/44.3 |
| 2007/0057386 | A1 * | 3/2007 | Koizumi | 261/44.8 |

FOREIGN PATENT DOCUMENTS

JP 52-1332 A * 1/1977

* cited by examiner

*Primary Examiner*—Richard L Chiesa
(74) *Attorney, Agent, or Firm*—Reising Ethington P.C.

(57) ABSTRACT

A valve is used with a carburetor, and the carburetor therefor. The valve has a throttle valve and an air valve. The air valve defines an air bore and has a baffle disposed within the air bore. The baffle separates one section of the air bore from another section, and impedes airflow through the air bore during at least some positions of the air valve.

20 Claims, 6 Drawing Sheets

LAYERED SCAVENGING CARBURETOR

REFERENCE TO RELATED APPLICATION

Applicants claim the priority to Japanese Patent Application No. 2006-222219 filed on Aug. 17, 2006, and Japanese Patent Application No. 2007-116978 filed on Apr. 26, 2007.

FIELD OF THE INVENTION

The present invention relates generally to carburetors, and more particularly to valves used in carburetors.

BACKGROUND OF THE INVENTION

Two-stroke internal combustion engines—such as those used in chainsaws, brushcutters, and the like—are often equipped with carburetors for mixing and supplying air and fuel to the engine. Layered scavenging carburetor arrangements having separate air-fuel passages and air passages can be used to reduce, and often prevent, undesirable blow-through and fuel-loss through its exhaust. But sometimes these arrangements generate air and fuel mixtures that are too lean for an idle operating condition or other low speed and low load conditions.

SUMMARY OF THE INVENTION

One embodiment of a valve for use in a carburetor may include a throttle valve and an air valve. The air valve defines an air bore and has a baffle disposed in the air bore that separates one section of the air bore from another section. In some positions of the air valve, the baffle impedes airflow through the air bore.

One embodiment of a carburetor for use in an internal combustion engine may include a carburetor body and a valve. The carburetor body defines an air-fuel passage and an air passage. The valve is carried by the carburetor body and may have a throttle valve that is disposed in the air-fuel passage, and also may have an air valve that is disposed in the air passage. The air valve defines an air bore and has a baffle carried in the air bore that separates one section from another section. During at least some positions of the air valve, the baffle impedes airflow through the air bore.

One embodiment of a carburetor for use in an internal combustion engine may include a carburetor body and a valve. The carburetor body defines an air-fuel passage and an air passage. The valve is carried by the carburetor body and may have a valve body with a rotary throttle valve and a rotary air valve, both valves having concurrent movements. The air valve defines an air bore and has a baffle fixed in the air bore that separates the air bore into equal sections. The valve may also have a needle valve that extends through the valve body and through the baffle. During at least some positions of the air valve, the baffle impedes airflow through the air bore.

BRIEF DESCRIPTION OF THE DRAWINGS

The following detailed description of preferred embodiments and best mode will be set forth with reference to the accompanying drawings, in which.

DETAILED DESCRIPTION OF PREFERRED EMBODIMENTS

Figure 1:
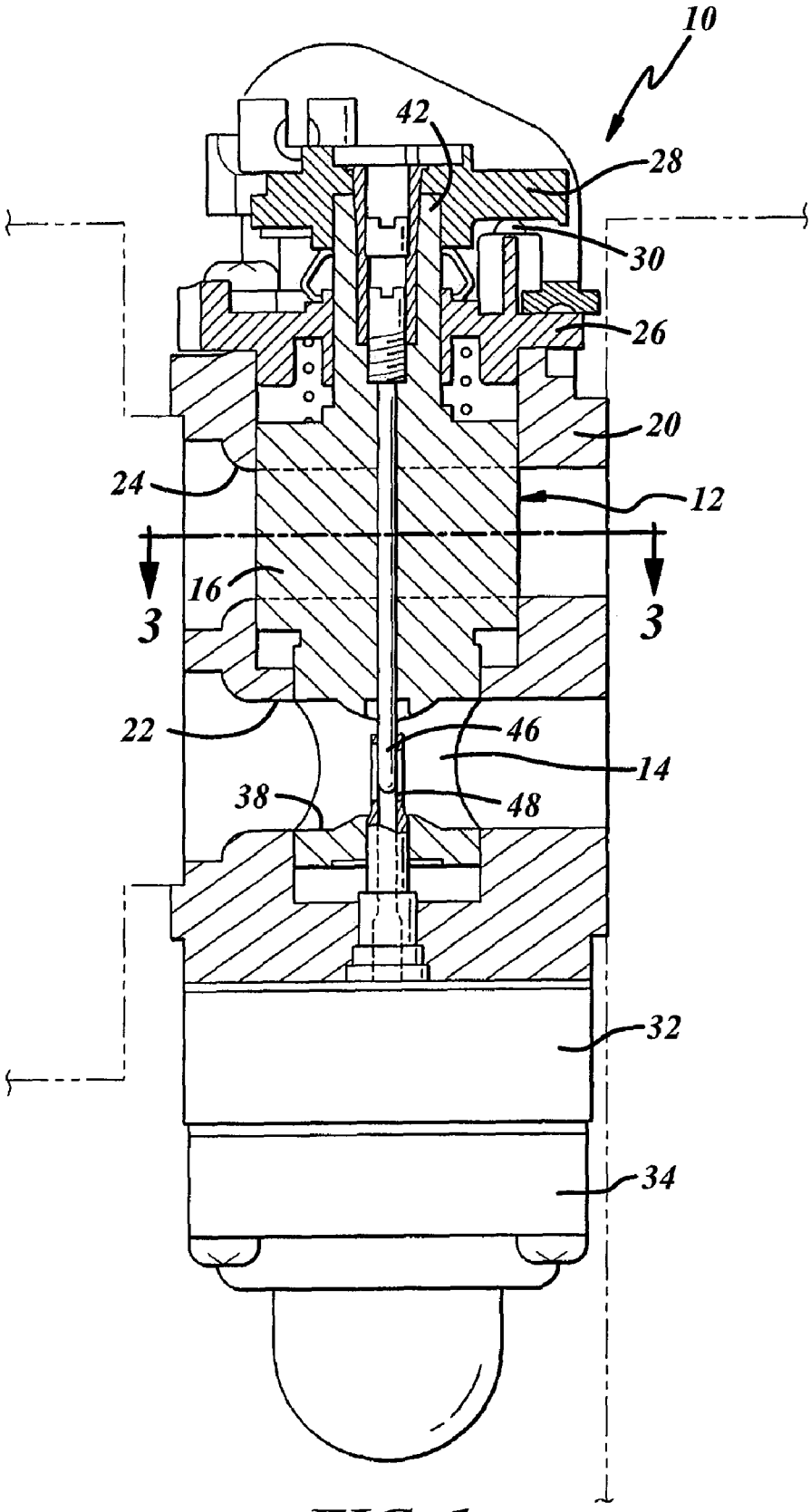
FIG. 1 is a sectional view of a carburetor showing a first embodiment of a valve.

Referring in more detail to the drawings, FIG. 1 shows a carburetor 10 that can be used in small two-stroke internal combustion engines like those found in chain saws, brushcutters, and the like. The carburetor 10 may include a valve 12 having a throttle valve 14 to regulate air and fuel flow, and an air valve 16 to regulate scavenging airflow. A baffle 18 (FIG. 2) is disposed in the air valve 16 to impede airflow through the air valve 16 to thus prevent air and fuel mixtures delivered from the carburetor 10 from becoming too lean at idle or other low speed and low load operating conditions of the associated internal combustion engine.

The carburetor 10 can, among other things, mix and supply air and fuel to the internal combustion engine. The carburetor 10 can come in other types not shown including a bowl or diaphragm type. As shown, the carburetor 10 has a layered scavenging arrangement that, as mentioned, may include the throttle valve 14 and the air valve 16. A carburetor body 20 supports and carries the valve 12, and defines an air-fuel passage 22 that communicates with the throttle valve 14 and the internal combustion engine, and also defines an air passage 24 which communicates with the air valve 16 and the internal combustion engine. A lid 26 may cover and retain the valve 12 once the valve is placed in the carburetor body 20. A lever 28 fixed to the valve 12 can rotate, in cooperation with a cam mechanism 30, to axially and rotatably adjust the position of the valve 12 and thereby adjust the air and fuel mixture supplied to the internal combustion engine. As shown, the carburetor 10 may further include a fuel control chamber 32 that can provide fuel to the valve 12, and an atmosphere chamber 34 that is diaphragmed to the fuel control chamber 32 to keep a constant supply pressure to the fuel. Skilled artisans will know the further components, and general construction, arrangement, and operation of these types of carburetors so that a more complete description will not be given here.

First Embodiment of Valve

Figure 2:
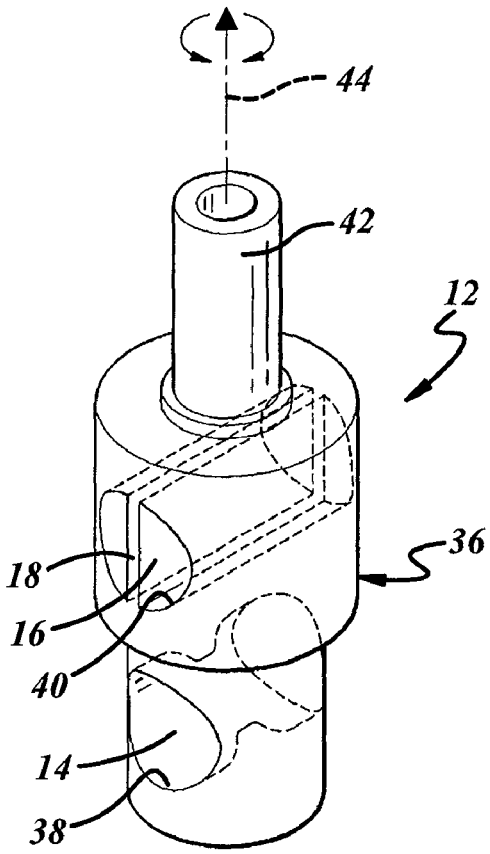
FIG. 2 is a perspective view of the valve of FIG. 1.

The valve 12 regulates fluid-flow through the carburetor 10 and to the associated internal combustion engine by permitting flow when the valve is open, preventing or substantially restricting flow when it is closed, and permitting partial flow therebetween. Referring to FIG. 2, in this embodiment a valve body 36 may be constructed out of one-piece, or composed of multiple pieces. The throttle valve 14 may be formed in a lower, smaller-diameter portion of the valve body 36, and the air valve 16 may be formed in an upper, larger-diameter portion of the valve body. The different valves each have a generally cylindrical shape that each define a center axis that may be parallel to each other. As shown here, both the throttle valve 14 and the air valve 16 are of the rotary type and thus are rotated to open and closed positions. The throttle valve 14 and the air valve 16 permit fluid-flow when the valves are open, prevent or substantially restrict flow when the valves are closed, or permit partial flow therebetween. The throttle valve 14 defines an air-fuel bore 38 through which fluid may flow, and the air valve 16 defines an air bore 40 through which fluid may flow. In general, the throttle valve 14 may include a venturi or restricted diameter throat which generates a drop in pressure and thus a greater vacuum through the throttle valve.

The valve body 36 may also form a valve shaft 42 that may lie concentric with a center axis 44 of the cylindrical valve body 36. The valve body 36 may rotate about the center axis 44. Referring back to FIG. 1, a metering needle valve 46 extends through the valve shaft 42 and through a center of the baffle 18 (FIG. 3A) and has a free end slidingly received in a fuel nozzle 48 exposed within the throttle valve 14. The decreased pressure generated by the venturi and the internal combustion engine causes fuel to flow out of the fuel control chamber 32 and the fuel nozzle 48 as is known by skilled artisans.

Figure 3A:
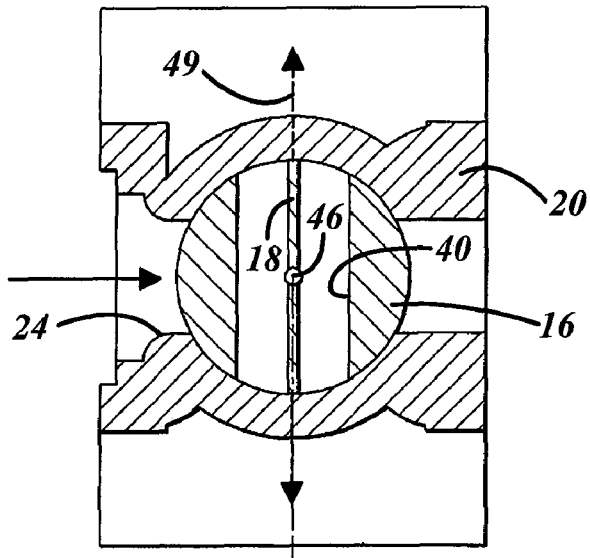
FIG. 3A is a sectional view taken along line 3-3 in FIG. 1 of an air valve.

The baffle 18 may be disposed in the air valve 16 to partially separate at least one section of the air bore 40 from another section. As will be subsequently described, in this way the baffle 18 impedes airflow through the air bore 40 during at least some positions of the air valve 16. Referring to FIGS. 2 and 3A, in the first embodiment, the baffle 18 is a solid rectangular plate. The baffle 18 can be constructed of a metal such as aluminum or steel, a plastic, a polymer, a composite material, or any other suitable material. The baffle 18 can be made unitary with the valve body 36, or can be a separate piece fixed in the air valve 16. The baffle 18 can be oriented parallel to and cut through the center axis 44. As best shown in FIG. 3A, the baffle 18 is coextensive with the air bore 40 and lies axially along a center axis 49 of the air bore 40. As a result, the baffle 18 divides the air bore 40 into two equal sections.

During the initial opening movement of the throttle valve 14, airflow through the air valve 16 is impeded, and consequently the air and fuel mixture provided to the internal combustion engine is richer than it would be without the baffle 18. In the first embodiment, the baffle 18 impedes airflow through the air bore 40 by obstructing, or blocking completely, the airflow up until the throttle valve 14 and the air valve 16 are about halfway toward their fully open positions. FIGS. 3A-6B show the sequential synchronized movements of the throttle valve 14 and the air valve 16 as the valves move from their fully closed positions to their fully opened positions. In these figures, the unmarked arrows represent the respective fluid-flows.

Figure 3B:
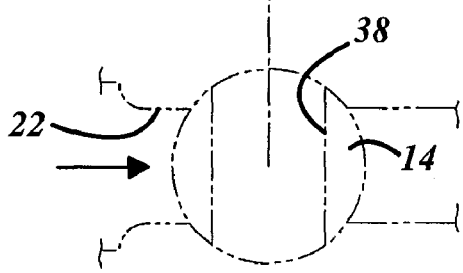
FIG. 3B is a phantom plan view of a throttle valve, showing the relative positions of both valves when they are fully closed.
Figure 4A:
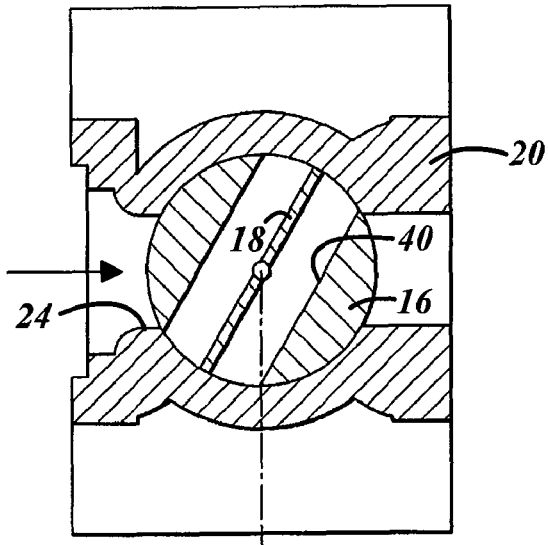
FIGS. 4A and 4B are views similar to FIGS. 3A and 3B showing the relative positions of the valves when they are moved toward open.
Figure 4B:
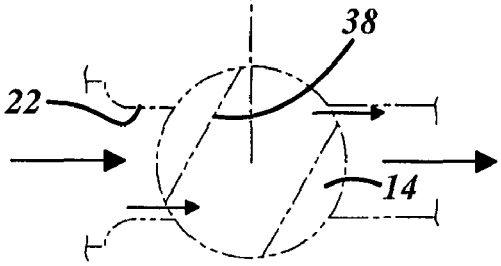
Figure 5A:
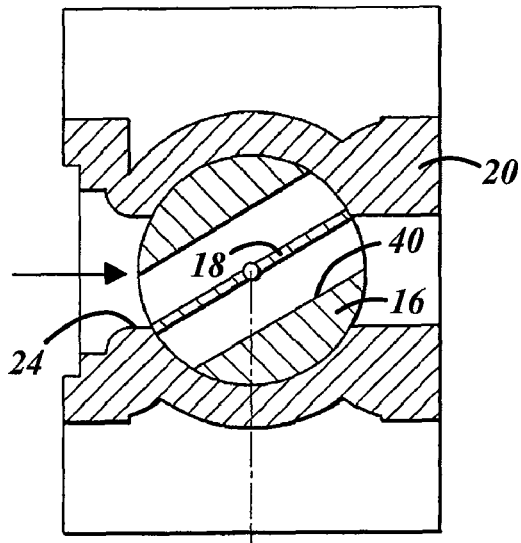
FIGS. 5A and 5B are views similar to FIGS. 3A and 3B showing the relative positions of the valves when they are moved halfway toward fully open.
Figure 5B:
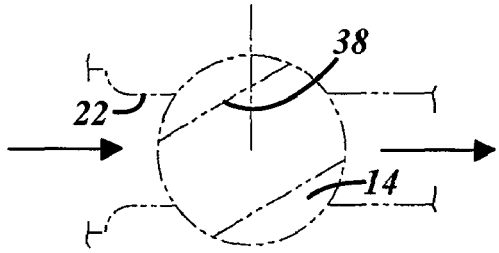
Figure 6A:
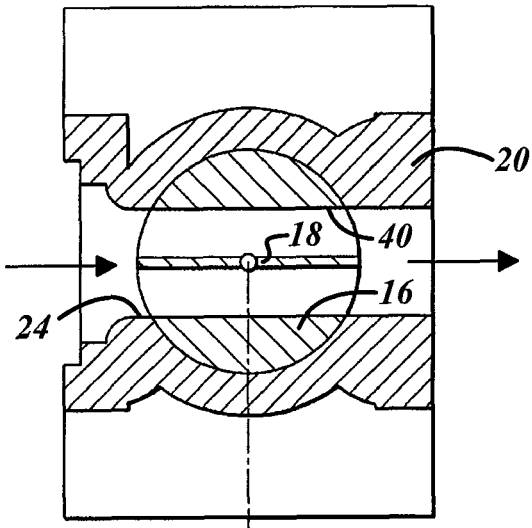
FIGS. 6A and 6B are views similar to FIGS. 3A and 3B showing the relative positions of the valves when they are fully open.
Figure 6B:
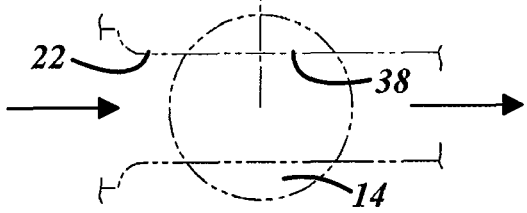

FIGS. 3A and 3B show the valves 14, 16 in a fully closed position where no or little air or fuel flows through the throttle valve 14, and no or little air flows through the air valve 16. In this position, the internal combustion engine can be turned off. FIGS. 4A and 4B show the throttle valve 14 slightly open where some air and fuel mixture exits the throttle valve and flows to the internal combustion engine; while the air valve 16 is still closed and little or no airflow passes therethrough. In this position, the internal combustion engine can be in an idle operating condition, or other low speed and low load condition. FIGS. 5A and 5B show the throttle valve 14 about halfway towards its fully open position allowing air and fuel mixture to flow therethrough; while the air valve 16 is also about halfway towards its fully opened position but does not allow airflow therethrough. In this position, the baffle 18 extends across one side of the air passage 24 to the other side and hence obstructs, or substantially completely blocks, any airflow that might otherwise pass therethrough. Only fluid-flow through the throttle valve 14 reaches the internal combustion engine. In this position, the internal combustion engine can be in a low speed and low load condition. Just beyond the halfway position, the baffle 18 may retard airflow through the air bore 40 by providing a reduced flow area or gap defined between the baffle and the air passage 24. FIGS. 6A and 6B show the throttle valve 14 in its fully open position and the air valve 16 in its fully open position. The internal combustion engine is in a wide-open throttle operating condition with fluid-flow passing through the throttle valve 14 and the air valve 16 virtually unimpeded.

Second Embodiment of Valve

Figure 7A:
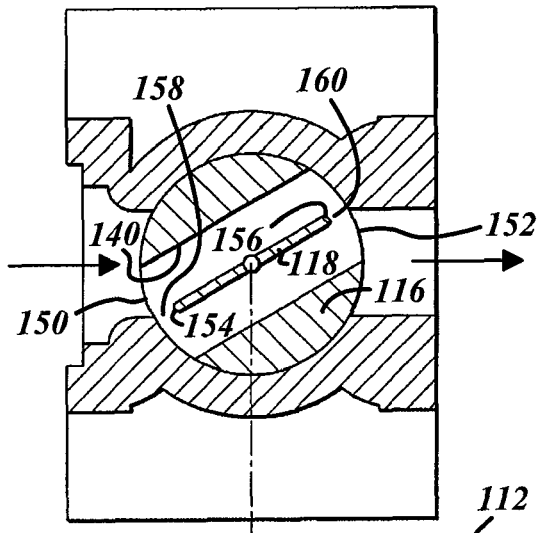
FIG. 7A is a sectional view of an air valve used in a second embodiment of a valve.
Figure 7B:
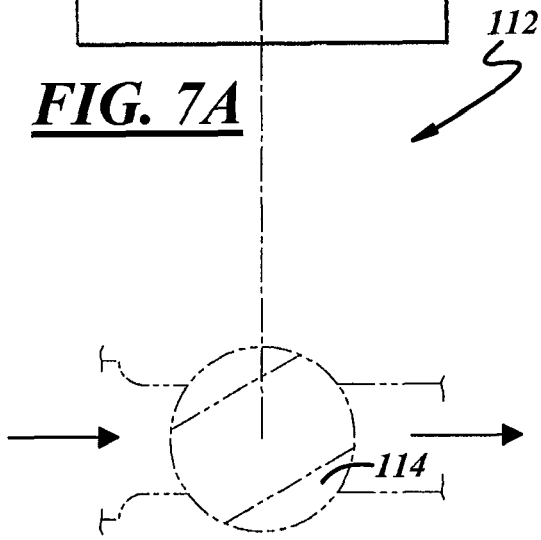
FIG. 7B is a phantom plan view of a throttle valve, showing the relative positions of both valves when they are moved halfway toward fully open.

FIGS. 7A and 7B show a second embodiment of a valve 112. This embodiment is similar to the first embodiment in many respects, and the similarities will not be repeated here. One difference is a baffle 118. The baffle 118 can be fixed in an air valve 116 and particularly in an air bore 140. The air bore 140 extends axially from a first end 150 to a second end 152, and the baffle 118 extends from a first end 154 to a second end 156. In this embodiment, the baffle 118 is not coextensive with the air bore 140. Instead, the first end 154 and the second end 156 of the baffle 118 are located within and away from the first end 150 and the second end 152 of the air bore 140, leaving voids such as a first gap 158 defined by the respective first ends, and a second gap 160 defined by the respective second ends. The baffle 118 may still lie along a center axis of the air bore 140 and may divide it into two equal sections or may be positioned otherwise as desired.

When in use, the baffle 118 impedes airflow through the air bore 140 by retarding, or slowing the airflow when a throttle valve 114 and the air valve 116 are about halfway toward their fully open positions as shown in FIGS. 7A and 7B. This position is just one example. The baffle 118 will retard airflow through the air bore 140 when the flow area between the air valve 116 and the air passage is greater than the flow area defined by the first and second gaps 158 and 160. Air passes through the air valve 116 with some air flowing around and through the first gap 158 and the second gap 160. In the position shown, the baffle 118 may retard airflow by partly extending across the air bore 140 and interrupting what would otherwise be a more direct fluid-flow path and reducing the airflow area. In a similar way, the baffle 118 retards airflow before and beyond the halfway position.

Third Embodiment of Valve

Figure 8:
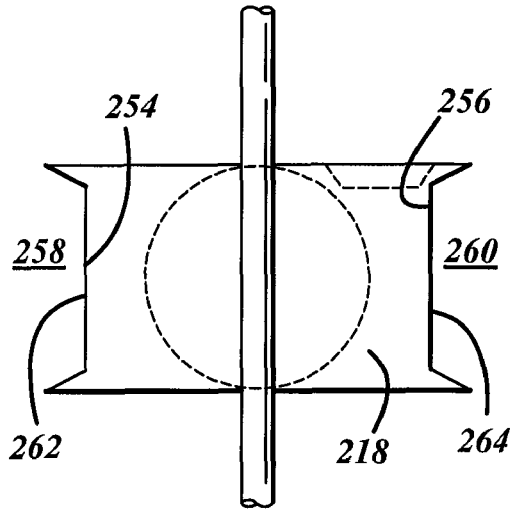
FIG. 8 is a side view of a baffle used in an air valve in a third embodiment of a valve.

FIG. 8 shows a third embodiment of a valve. This embodiment is similar to the first embodiment in many respects, and the similarities will not be repeated here. One difference is a baffle 218. Although not shown, the baffle 218 may be fixed in an air valve, and particularly in an air bore that extends from a first end to a second end. The baffle 218 extends from a first end 254 to a second end 256. In this embodiment, the baffle 218 may define one or more voids or cutouts in its periphery.

For example, a first cutout 262 may be carved in the first end 254 and a second cutout 264 may be carved in the second end 256; as shown by phantom, other cutouts may be carved on other sides of the baffle 218. Without the first and second cutouts 262 and 264, the baffle 218 would be coextensive with the first and second end of the air bore. The cutouts themselves can also take numerous shapes and sizes other than the ones shown. The first and second cutouts 262 and 264 respectively define a first gap 258 and a second gap 260 with the air bore similar to how the gaps of the second embodiment were defined. The baffle 218 may still lie along a center axis of the air bore and may still divide it into two equal sections, or may be positioned otherwise as desired.

When in use, the baffle 218 impedes airflow through the air bore by retarding, or slowing, the airflow when the throttle valve and the air valve are in certain positions. For example, when the air valve initially opens, i.e., when a flow area or gap develops between the air valve and an associated air passage, airflow may pass through that flow area and through the first and second gaps 258 and 260. As another example, the baffle 218 will retard airflow through the air bore when the flow area between the air valve and the air passage is greater than the flow area defined by the first and second gaps 258 and 260. In these examples, the baffle 218 retards airflow by extending across the air bore to interrupt what would otherwise be a more direct fluid-flow path and reducing the airflow area.

Fourth Embodiment of Valve

Figure 9:
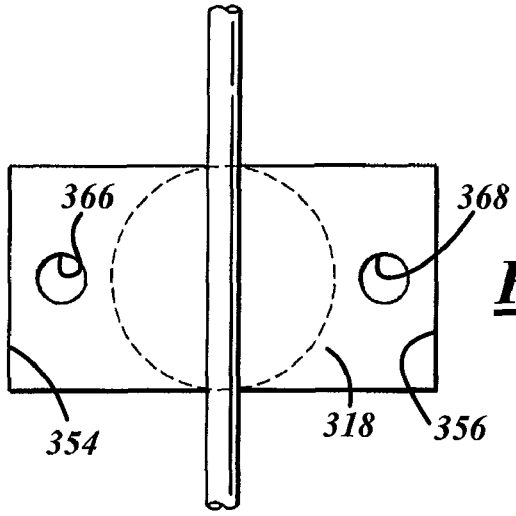
FIG. 9 is a side view of a baffle used in an air valve in a fourth embodiment of a valve.

FIG. 9 shows a fourth embodiment of a valve. This embodiment is similar to the first embodiment in many respects and the similarities will not be repeated here. One difference is a baffle 318. Although not shown, the baffle 318 may be fixed in an air valve, and particularly in an air bore that extends from a first end to a second end. The baffle 318 may be coextensive with the air bore and extend from a first end 354 to a second end 356. The baffle 318 may define one or more voids or openings extending through its body and being bounded at least partially, and in some embodiments completely by its body. The openings may take numerous shapes, sizes, and locations in the baffle 318. For example, as shown, a first circular opening 366 may be defined adjacent the first end 354, and a second circular opening 368 may be defined adjacent the second end 356. The baffle 318 may still lie along a center axis of the air bore and may divide the air bore into two equal sections, or may be positioned otherwise as desired.

When in use, the baffle 318 impedes airflow through the air bore by retarding, or slowing, the airflow when the throttle valve and the air valve are in certain positions. For example, when the air valve initially opens, i.e., when a flow area or gap develops between the air valve and an associated air passage, airflow may pass through that flow area and through the first and second openings 366 and 368. As another example, the baffle 318 will retard airflow through the air bore when the flow area between the air valve and the air passage is greater than the flow area defined by the first and second openings 366 and 368. In these examples, the baffle 318 retards airflow by extending across the air bore and interrupting what would otherwise be a more direct fluid-flow path and reducing the airflow area.

Fifth Embodiment of Valve

Figure 10:
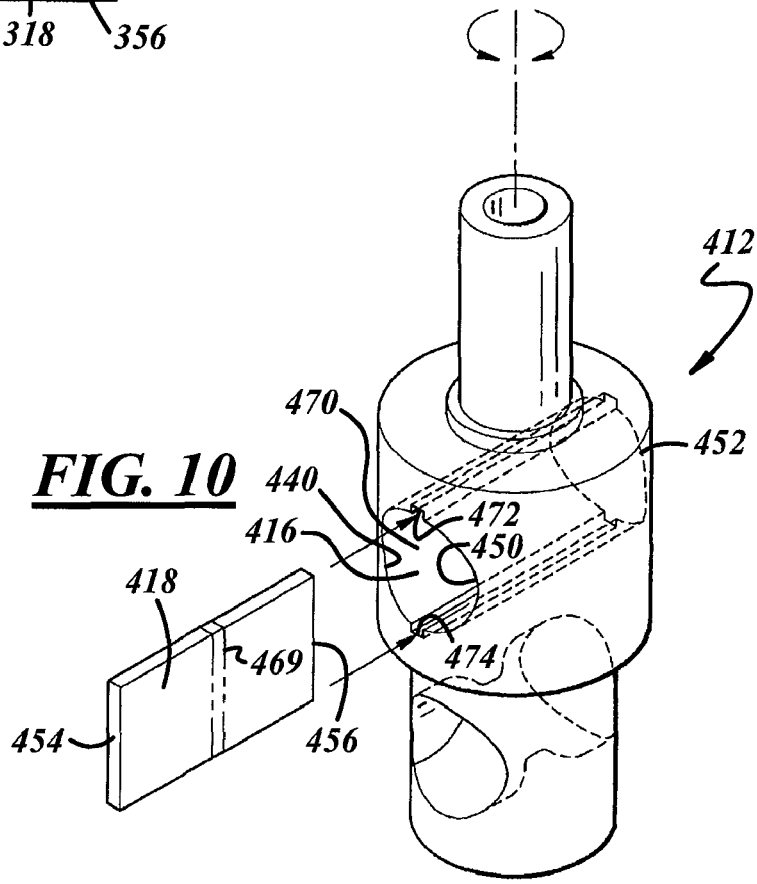
FIG. 10 is an exploded perspective view of a fifth embodiment of a valve.

FIG. 10 shows a fifth embodiment of a valve. This embodiment is similar to the first embodiment in many respects, and the similarities will not be repeated here. One difference is an air bore 440. A baffle 418 is disposed in an air valve 416 and particularly in the air bore 440. The air bore 440 may have a generally cylindrical shape that extends from a first end 450 to a second end 452. The baffle 418 may be coextensive with the air bore 440 and can extend from a first end 454 to a second end 456. In this embodiment, the baffle 418 is sized larger in a radial direction with respect to the air bore 440 and may have a slot 469 (in phantom) extending radially (with respect to the air bore) through its body to receive a needle valve. The slot may be present in other embodiments. The air bore 440 has a cylindrical wall 470 defining a first groove 472 channeled in the wall 470 on one side, and defining a second groove 474 channeled in the wall on an opposite side. The first groove 472 and the second groove 474 outfit the air bore 440 for a press-fit with the baffle 418 to thereby fix the baffle in the air bore. The grooves are accordingly sized and shaped to receive the respective sides and edges of the baffle 418. The grooves extend axially from the first end 150 and to the second end 152 of the air bore 440, and protrude radially beyond the wall 470. In other embodiments not shown, only a single groove may be present in the air bore 440.

Sixth Embodiment of Valve

Figure 11:
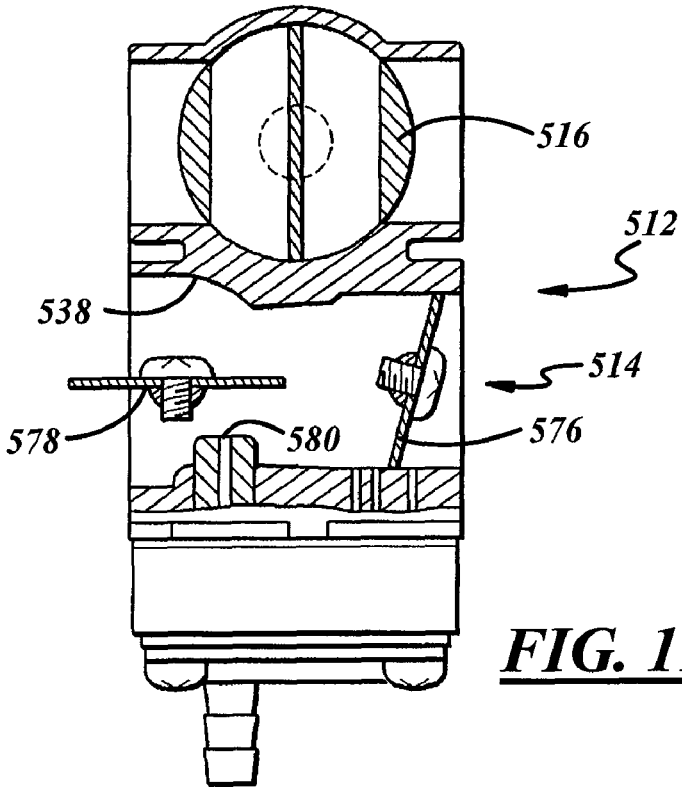
FIG. 11 is a fragmentary sectional view of a sixth embodiment of a valve.

FIG. 11 shows a sixth embodiment of a valve. This embodiment is similar to the first embodiment in some respects, and the similarities will not be repeated here. One difference is a throttle valve 514. The throttle valve 514 may include a butterfly valve 576 and a fuel-injection nozzle or jet 580. The valve may also include a choke valve 578. Together, these components regulate air-fuel flow to the internal combustion engine as will be known to skilled artisans. The valves may be circular plates that are attached to and rotated by respective shafts. When rotated perpendicular with respect to a center axis of an air-fuel bore 538, the butterfly and choke valve 576 and 578 prevent or restrict fluid-flow therethrough; and when rotated parallel to the center axis of the air-fuel bore 538, the butterfly and choke valve 576 and 578 permit fluid-flow therethrough. An air valve 516 may be a rotary valve.

Figure 12:
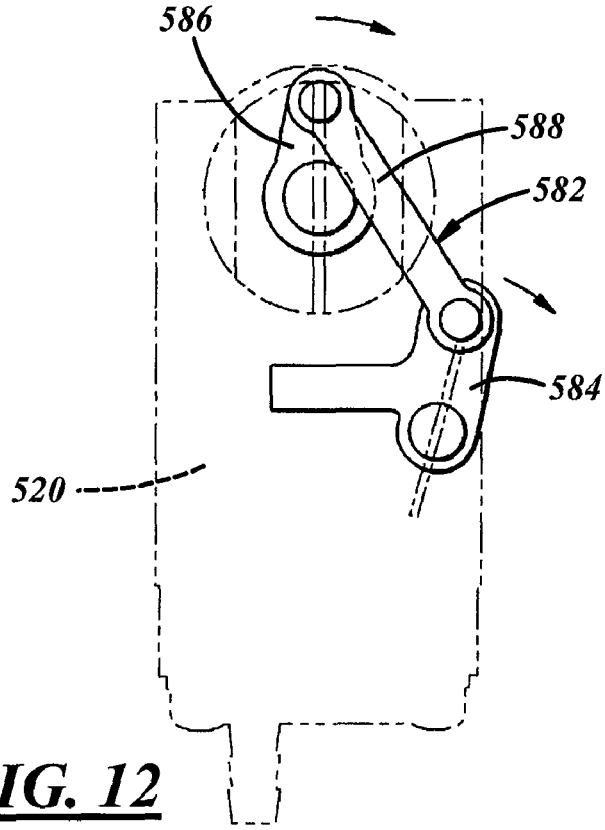
FIG. 12 is a side view of a linkage used with a valve.

Referring to FIG. 12, this embodiment may include a linkage 582 that operably connects the shafts of the throttle valve 514 and the air valve 516 to substantially synchronize the movements of the valves. In other words, the opening or closing of the throttle valve 514 translates into concurrent respective opening or closing of the air valve 516. The linkage 582 may be equipped outside of a carburetor body 520, or outside of the valve body (not shown). The linkage 582 may comprise a first lever 584 connected to the shaft of the throttle valve 514, a second lever 586 connected to the shaft of the air valve 516, and a link rod 588 pivoted to and connecting the first and second levers. The levers and link rod work together to provide the above-mentioned synchronized movement.

Seventh Embodiment of Valve

Figure 13:
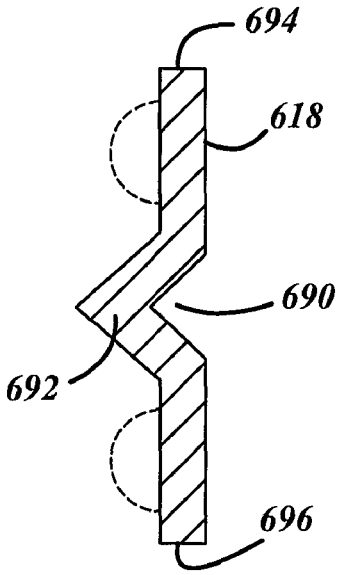
FIG. 13 is a sectional side view of a baffle used in an air valve in a seventh embodiment of a valve.

FIG. 13 shows a seventh embodiment of a valve. This embodiment is similar to the first embodiment in some respects, and the similarities will not be repeated here. One difference is a baffle 618. Although not shown, the baffle 618 may be fixed in an air valve, and particularly in an air bore. The baffle 618 may but need not be coextensive with the air bore, and may have one or more voids 690 formed in the baffle 618. The one or more voids may come in various numbers, locations, shapes and sizes to form a break in continuity as compared to a uniform baffle. For example, there may be a single void 690 as shown defined at least in part by a bend or ridge 692 in the baffle 618. In other embodiments, for example, the void may make or be formed by a bend, bulge or other shape, and there may be one or more of them as shown in phantom. The single void 690 may extend lengthwise across the entire baffle 618. The void 690 may be parallel with the top and bottom edges 694, 696 of the baffle 618, or could be oriented on an angle with respect to the edges.

When in use, the baffle 618 impedes airflow through the air bore by retarding, or slowing, the airflow when the throttle valve and the air valve are in certain positions. For example, when the air valve initially opens, i.e., when a flow area or gap develops between the air valve and an associated air passage, airflow may pass through the void 690. The ridge 692 and the void 690 breach the air passage before the rest of the otherwise planar baffle 618 when the air valve is opening to enable airflow therethrough. In this example, the baffle 618 retards airflow by extending across the air bore and interrupting what would otherwise be a more direct fluid-flow path and reducing the airflow area.

Although not particularly described, subject matter of each of the several embodiments can be used with each other. For example, a baffle may define one or more cutouts and be press-fit into grooves defined in an air bore. Likewise, a single baffle can define one or more openings and one or more cutouts, and still retard airflow through an air bore. Also, an air valve having a baffle defining one or more cutouts can be used with a throttle valve comprising a butterfly valve.

Furthermore, the described baffles need not divide the air bore into equal sections nor lie axially along the center axis of the air bore. Indeed, the baffle can be oriented at different angles with respect to the center axis the air bore; for example, the baffle can be rotated or pivoted about the needle valve when viewed in plan as in FIG. 3A, or can be rotated or pivoted in another view about an axis perpendicular to the needle valve. In both examples, and others, the baffle may still interrupt an otherwise more direct fluid-flow path and thus impede airflow through the air bore.

In at least the embodiments comprising the rotary throttle valve and the rotary air valve, the valve body may be constructed with the valves being oriented generally parallel and stacked one on top of the other whereby a single and simultaneous rotation about the valve shaft can open and close both valves. In some cases, such a construction may simplify manufacturing and operation. The baffle, in part, enables this construction by impeding airflow through the air valve when excessive air is undesirable.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. A valve for use in a carburetor, the valve comprising:

a throttle valve; and an air valve body defining an air bore and having a baffle disposed within the air bore to separate one section of the air bore from another section, wherein in at least some positions of the air valve the baffle impedes airflow through the air bore.

2. The valve of claim 1 further comprising a choke valve, and wherein the throttle valve includes a butterfly valve.

3. The valve of claim 2 further comprising a linkage operably connecting the throttle valve and the air valve to synchronize the valves respective opening and closing movements.

4. The valve of claim 1 wherein the throttle valve is a rotary valve and the air valve is a rotary valve, and wherein both valves constitute part of the valve body which rotates about a center axis and which also includes a valve shaft.

5. The valve of claim 4 further comprising a needle valve disposed in the valve shaft and having a free end slidingly received in a fuel nozzle within the throttle valve.

6. The valve of claim 1 wherein the baffle i) is coextensive with the air bore, ii) lies axially along a center axis of the air bore, iii) is a solid plate, iv) divides the air bore into equal sections, and wherein in at least some positions of the air valve the baffle obstructs airflow through the air bore.

7. The valve of claim 1 wherein the air bore has a first end, and the baffle has a first end that is spaced within and away from the first end of the air bore to form a first gap, and wherein in at least some positions of the air valve the baffle retards airflow through the air bore by enabling airflow through the first gap.

8. The valve of claim 1 wherein the baffle defines one or more cutouts in the periphery of the body, and wherein in at least some positions of the air valve the baffle retards airflow through the air bore by enabling airflow through the one or more cutouts.

9. The valve of claim 8 wherein the body has a first end defining a first cutout, and a second end located opposite the first end defining a second cutout.

10. The valve of claim 1 wherein the baffle defines one or more openings through the body and that are bounded by the body, and wherein in at least some positions of the air valve the baffle retards airflow through the air bore by enabling airflow through the one or more openings.

11. The valve of claim 1 wherein the baffle has one or more voids formed in the body, and wherein in at least some positions of the air valve the baffle retards airflow through the air bore by enabling airflow through the one or more voids.

12. The valve of claim 1 further comprising at least one groove formed in the air bore and wherein the baffle is received in the at least one groove to be disposed in the air bore.

13. A carburetor for use with an internal combustion engine, the carburetor comprising:

a carburetor body defining an air-fuel passage and an air passage; and a valve carried by the carburetor body and having a throttle valve disposed in the air-fuel passage and an air valve disposed in the air passage, the air valve having a valve body defining an air bore and having a baffle carried in the air bore to separate one section of the air bore from another section, wherein the baffle impedes airflow through the air bore in at least some positions of the air valve.

14. The carburetor of claim 13 further comprising a needle valve disposed in the valve and having a free end slidingly received in a fuel nozzle within the throttle valve.

15. The carburetor of claim 13 wherein the baffle i) is coextensive with the air bore, ii) lies axially along a center axis of the air bore, iii) is a solid plate, iv) divides the air bore into equal sections, and wherein the baffle obstructs airflow through the air bore in at least some positions of the air valve.

16. The carburetor of claim 13 wherein the air bore extends from a first end to a second end, and the baffle extends from a first end to a second end that are respectively spaced within and away from the first and second ends of the air bore to form a first and second gap, and wherein the baffle retards airflow through the air bore by enabling airflow through the first and second gaps in at least some positions of the air valve.

17. The carburetor of claim 13 wherein the baffle defines one or more cutouts in the periphery of the valve body, and wherein the baffle retards airflow through the air bore by enabling airflow through the one or more cutouts in at least some positions of the air valve.

18. The carburetor of claim 13 wherein the baffle defines one or more openings through the valve body and that are bounded by the valve body, and wherein the baffle retards airflow through the air bore by enabling airflow through the one or more openings in at least some positions of the air valve.

19. The carburetor of claim 13 wherein the valve further comprises at least one groove formed in the air bore and wherein the baffle is received in the at least one groove to be disposed in the air bore.

20. A carburetor for use with an internal combustion engine, the carburetor comprising:

a carburetor body defining an air-fuel passage and an air passage; and a valve carried by the carburetor body and having a valve body with a rotary throttle valve disposed in the air-fuel passage and a rotary air valve disposed in the air passage, the throttle valve and the air valve having concurrent movements, the air valve defining an air bore and having a baffle disposed in the air bore to separate the air bore into equal sections, the valve further having a needle valve extending through the valve body and through the baffle into the throttle valve to provide fuel therein, wherein the baffle impedes airflow through the air bore during at least some positions of the air valve.

* * * * *